US006908648B2

(12) United States Patent
Kasahara

(10) Patent No.: US 6,908,648 B2
(45) **Date of Patent: *Jun. 21, 2005**

(54) INK-JET RECORDING SHEET

(75) Inventor: Kenzo Kasahara, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/388,158

(22) Filed: Mar. 13, 2003

(65) Prior Publication Data

US 2003/0186020 A1 Oct. 2, 2003

(30) Foreign Application Priority Data

Mar. 22, 2002 (JP) ..... 2002-079856

(51) Int. Cl.[7] ..... B41M 5/00

(52) U.S. Cl. ..... 428/32.25; 428/32.3; 428/32.34; 428/32.37

(58) Field of Search ..... 428/32.25, 32.3, 428/32.34, 32.37, 32.14, 32.15, 32.31

(56) References Cited

U.S. PATENT DOCUMENTS 6,114,020 A * 9/2000 Misuda et al. ..... 428/32.35
2003/0104177 A1 * 6/2003 Kasahara ..... 428/195

FOREIGN PATENT DOCUMENTS

EP 0 286 427 A 10/1988
EP 1016542 A1 * 7/2000 ..... B41M/5/00
EP 1 211 088 A 6/2002
JP 2003-335049 * 11/2003

OTHER PUBLICATIONS

Patent Abstracts of Japan, vol. 0122, No. 82 (M–726), Aug. 3, 1988 of JP 63 060784 A (Fuji Photo Film Co., Ltd.) Mar. 16, 1988.

* cited by examiner

*Primary Examiner*—Pamela R. Schwartz
(74) *Attorney, Agent, or Firm*—Frishauf, Holtz, Goodman & Chick, P.C.

(57) ABSTRACT

An ink-jet recording sheet containing a support having the following layers in the order: (a) a porous layer; and (b) a surface porous layer containing an organic particle A or an organic particle B, the organic particle A being insoluble in water and soluble in or swollen in a water soluble organic solvent having a SP value of 18.41 to 30.69 $(MPa)^{1/2}$ and a boiling point of not less than 120° C.; the organic particle B comprising a copolymer having a specific recurring unit in an amount of not less than 5 weight % based on the total weight of the copolymer; the organic particle A and the organic particle B each having an average particle size of not more than 100 nm and a glass transition temperature of not less than 70° C., wherein the porous layer or the surface porous layer contains a compound having a polyvalent metal element.

7 Claims, 1 Drawing Sheet

INK-JET RECORDING SHEET

FIELD OF THE INVENTION

The present invention relates to an ink-jet recording sheet (hereinafter, also referred to as merely a recording sheet), particularly to a void type or porous ink-jet recording sheet which exhibits improved discoloration property and bleeding property without a reduction of ink absorption rate.

BACKGROUND OF THE INVENTION

Ink-jet recording is a recording method to record images and letters with ejection of minute ink droplets by various working principles onto a recording sheet, such as paper, exhibiting advantages of relatively high speed, low noise and simplified multi-color printing.

Nozzle clogging and maintenance of the foregoing recording method has been improved in both ink and apparatus, and in recent years, ink-jet recording has rapidly become popular in various fields of printers, facsimile machines and printers for computers.

Recently, ink-jet printers have specifically resulted in enhancement of image quality which is approaching that of conventional silver halide photography, and thus, it is required that a recording sheet also duplicates conventional photographic quality, and then reproduces the aesthetic property of silver halide photography (such as glossiness, smoothness and stiffness).

As one of methods to reproduce said aesthetic property of silver halide photography, a so-called swelling type recording sheet has become common, comprised of a hydrophilic binder, such as gelatin and polyvinyl alcohol, applied onto a support. However, this method has weaknesses of low ink absorption rate, a tendency of a sticky surface after printing, and image bleeding due to ambient humidity during storage. Specifically, ink droplets are easily blended before they are absorbed due to low ink absorption rate, resulting in bleeding into different colors and beading or unevenness in the same color. Thus, achievement of the desired silver halide photographic image quality has been rather difficult.

So-called void type recording sheets are becoming the main types instead of the foregoing swelling types. High ink absorption rate is a major feature due to effective ink absorption into minute voids. Examples of the recording sheets which approach silver halide photograph image quality and silver halide photograph aesthetic property are described in JP-A Nos. 10-119423, 10-119424, 10-175364, 10-193776, 10-193776, 10-217601, 11-20300, 11-106694, 11-321079, 11-348410, 10-178126, 11-348409, 2000-27093, 2000-94830, 2000-158807, and 2000-211241 (hereinafter, JP-A refers to Japanese Patent Application Publication).

In addition to image quality and aesthetic property, durability and image stability are highly demanded. Many attempts have been made to achieve the same levels of light stability, moisture resistance and water fastness as those of silver halide photograph. Examples of technology to enhance light stability are disclosed in JP-A Nos. 57-74192, 57-87989, 57-74193, 58-152072, 64-36479, 1-95091, 1-115677, 3-13376, 4-7189, 7-195824, 8-25796, 11-321090, 11-277893, 2000-37951 and others.

Regarding void type recording sheets, they tend to cause problems such as discoloration with specific gases due to its void structure in addition to other light stability problems. Specifically, phthalocyanine water-based dyes employed in common color ink-jet printers tend to cause such discoloration.

The mechanism of this discoloration property has not yet been fully clarified, but it is assumed that the minute porous structure has a large surface area and the inorganic particles used therein have active surfaces, resulting in decomposition of dyes by minute quantities of reactive gases in the ambient air such as ozone, oxidants, SOx and NOx.

Techniques to minimize the discoloration problem are disclosed, for example, in JP-A Nos. 63-252780, 64-11877, 1-108083, 1-216881, 1-218882, 1-258980, 2-188287, 7-237348, 7-266689, and 8-164664. This discoloration problem is a more prominent deteriorating problem in recording sheets exhibiting photograph image quality having an enhanced minute porous structure, and thus, the relevant art for improvement has not been sufficient to obtain the desired effect, calling for fundamental improvement.

One of the countermeasures to the foregoing problem is to use a swelling-type recording sheet, but on the other hand, it is very difficult to improve the critical matter of slow ink absorption rate by the use of this type of sheet.

The discoloration property is overcome to a certain degree with an ink-jet recording method using pigment inks. However, this technology cannot fully eliminate properties such as bronzing of image on the recording sheet to yield a desirable image quality. In addition, a gas insulating method which uses a laminating process for prints and framed printed photos are known. Moreover, a gas insulating layer forming methods are also are disclosed. Examples are disclosed in JP-A Nos. 53-27426, 59-222381, 62-271781, 11-157207, 11-245507, and 2000-71608, in which after printing is carried out on a image recording sheet containing thermoplastic particles on the surface thereof, a gas insulating layer is formed using a heating or pressure treatment.

Further, a recording sheet comprised of a void layer containing fine organic particles and fine inorganic particles is disclosed in JP-A 63-60784. However, these fine organic particles can only be dissolved in special solvents, not normally used in the organic solvents employed in the common ink-jet printer ink, and thus, cannot presently be employed for normal ink-jet recording.

The inventors of the present invention had found that the specific fine organic particles contained in a coated layer on a recording sheet are very effective in preventing discoloration. Specifically, it is effective to provide a high concentration of these fine organic particles in the surface porous layer.

However, as a result of continued study, the above structure has proved to have a tendency of a slow ink absorption rate, resulting in easily generated beading on printed images. In the future, under the expectation that printing speed will be improved, achievement of an early solution is urgently sought.

SUMMARY OF THE INVENTION

From the viewpoint of the foregoing, the present invention has been achieved. An object of the present invention is to provide a void (or porous) type, ink-jet recording sheet which exhibits minimized discoloration and bleeding without a reduction of ink absorption rate.

The foregoing object of the present invention was achieved employing the embodiments below.

(1) According to one embodiment of the present invention, an ink-jet recording sheet is provided, an ink-jet recording sheet comprising a support having thereon the following layers in the order:

(a) a porous layer; and (b) a surface porous layer comprising an organic particle A or an organic particle B, the organic particle A being insoluble in water and soluble in or swollen in a water soluble organic solvent having a SP value of 18.41 to 30.69 $(MPa)^{1/2}$ and a boiling point of not less than 120° C.;

the organic particle B comprising a copolymer having a recurring unit represented by Formula (1) in an amount of not less than 5 weight % based on the total weight of the copolymer, Formula (1)

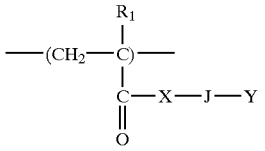

wherein X represents —O— or —N($R_2$)—; $R_1$ represents a hydrogen atom or a methyl group; $R_2$ represents a hydrogen atom or an alkyl group having 1 to 8 carbon atoms; J represents an alkylene group having 2 to 18 carbon atoms which may be substituted with an ether group or thioether group when X is —O—, or J represents a single bond or an alkylene group having 2 to 8 carbon atoms which may be substituted with an ether group or thioether group when X is —N($R_2$)—; and Y represents a hydrogen atom, a hydroxyl group, an amino group or an alkoxy group; and the organic particle A and the organic particle B each having an average particle size of not more than 100 nm and a glass transition temperature of not less than 70° C., wherein the porous layer or the surface porous layer comprises a compound having a polyvalent metal element.

(2) According to one embodiment of the present invention, an ink-jet recording sheet is provided, the ink-jet recording sheet described in the above embodiment 1, wherein said compound containing a polyvalent metal element is a compound containing zirconium or aluminum atoms.

Other embodiment of the present invention are as follows.

(3) The ink-jet recording sheet of the above embodiment 2, wherein the compound having a polyvalent metal is present in an amount of 0.05 to 5.00 $g/m^2$ in the ink-jet recording sheet.

(4) The ink-jet recording sheet of the above embodiment 1, wherein the organic particle B comprises a copolymer having a recurring unit represented by Formula (1) in an amount of not less than 10 weight % based on the total weight of the copolymer, (5) The ink-jet recording sheet of the above embodiment 1, wherein the organic particle A and the organic particle B each has an average particle size of not more than 60 nm.

(6) The ink-jet recording sheet of the above embodiment 1, wherein the surface porous layer comprises the organic particle A or an organic particle B in an amount of 50 to 90 weight % based on the total weight the surface porous layer.

(7) The ink-jet recording sheet of the above embodiment 1, wherein the porous layer comprises the compound having a polyvalent metal element.

An ink-jet recording sheet provided with a surface porous layer being porous and containing specified fine organic particles exhibits a superior anti-discoloration property, but on the other hand, exhibits an undesirable low ink absorption rate. The inventors have diligently studied the contributing factors, and have proved that one of the factors to reduce the ink absorption rate is a cationic polymer used as a dye fixing agent in the inventive ink-jet recording sheet. A cationic polymer functions to fix a dye in the ink to the recording material, and enhances quick swelling with water in the ink due to the structural characteristics of a water-soluble polymer. Therefore, a water-soluble polymer in a minute pore structure of an ink-jet recording sheet facilitates swelling with a solvent, resulting in the tendency to retard the ink absorption rate of an ink-jet recording sheet.

The inventors of the present invention performed diligent investigations to enhance the fixing ability of a dye without retarding the ink absorption rate in an ink-jet recording sheet containing fine organic particles in the surface porous layer as described earlier. As a result, it was discovered that employment of a polyvalent metal compound as a dye fixing agent was quite effective, resulting in achievement of the present invention. Further, it was proved that the use of a polyvalent metal compound was not only more beneficial to the ink absorption rate but also more effective in enhancing the anti-discoloration effect. The reason for these effects has not been fully clarified yet at present, however, it is assumed that it depends on the position where the dye is fixed. Namely, a dye is fixed primarily surface of an ink absorbing layer when fixed with a cationic polymer, however, a dye is fixed primarily interior of an ink absorbing layer, resulting in being minimally affected by harmful gases which are assumed to be the cause of discoloration.

DESCRIPTION OF THE PREFERRED EMBODIMENTS

Figure 1:
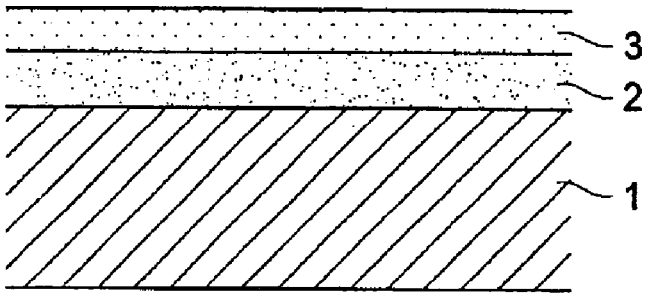
FIG. 1 represents a schematic diagram of one of the embodiment of the present invention.

The present invention will now be detailed as follows. An ink-jet recording sheet of the present invention (such as shown in FIG. 1) comprises a support (indicated as number 3 in FIG. 1) having thereon a surface porous layer (indicated as number 1 in FIG. 1) being porous and containing an organic particle A or an organic particle B, both of which are defined in the foregoing paragraph, and at least one porous layer (indicated as number 2 in FIG. 1), and at least one of the surface porous layer or the porous layer comprises a compound containing a polyvalent metal element.

The surface porous layer provided on a porous layer is a porous layer (or a layer having voids), and a porous which basically contains organic particles described later.

Initially, organic particle A and organic particle B of the present invention will be detailed.

Organic particles A of the present invention are defined as water insoluble organic particles having a tendency to dissolve or swell in a water soluble organic solvent having a SP value between 18.41–30.69 $(MPa)^{1/2}$ and a boiling point of at least 120° C., and exhibiting a glass transition temperature of at least 70° C. and an average particle size of at most 100 $\mu$m.

The SP value in the present invention is defined as Solubility Parameter, and is useful to estimate solubility of a substance. The SP value is indicated by $(MPa)^{1/2}$ and determined at 25° C.

The SP value of an organic solvent is described in POLYMER HANDBOOK, Chap. IV, Pg. 337, J. Brandrup, et al., published by A Wiley-interscience Publication Co., and various other literatures.

Examples of representative water soluble organic solvents (typical SP value is indicated in parentheses) include alcohols [e.g., butanol (23.3), isobutanol (21.5), secondary butanol (22.1), tertiary butanol (21.7), pentanol, hexanol, cyclohexanol (23.3), and benzyl alcohol (24.8)]; polyhydric alcohols [e.g., ethylene glycol (29.9), diethylene glycol (24.8), triethylene glycol (21.9), polyethylene glycol, propylene glycol (25.8), dipropylene glycol (20.5), polypropylene glycol, butylenes glycol, hexanediol (21.1), pentanediol, glycerin (33.8), hexanetriol, and thiodiglycol]; alkyl ethers of polyhydric alcohols [e.g., ethylene glycol monomethyl ether (23.3), ethylene glycol monoethyl ether (21.5), ethylene glycol monobutyl ether, ethylene glycol dimethyl ether (17.6), diethylene glycol monomethyl ether (23.3), diethylene glycol monoethyl ether, diethylene glycol monobutyl ether, diethylene glycol dimethyl ether, diethylene glycol diethyl ether, triethylene glycol monoethyl ether, triethylene glycol monomethyl ether, triethylene glycol monobutyl ether, triethylene glycol diethyl ether, triethylene glycol dimethyl ether, tetraethylene glycol monomethyl ether, tetraethylene glycol monoethyl ether, tetraethylene glycol monobutyl ether, tetraethylene glycol dimethyl ether, and tetraethylene glycol diethyl ether]; amines [e.g., ethanolamine, diethanolamine, triethanolamine, N-methyldiethanolamine, N-ethyldiethanolamine, morfoline, N-ethylmorfoline, ethylenediamine (25.2), diethylenetriamine, triethylenetetramine, tetraethylenepentamine, polyethyleneimine, pentamethyldiethylenetriamine, and tetramethylpropylenediamine]; amides [e.g., formamide, N,N-dimethylformamide, and N,N-dimethylacetamide]; heterocyclic compounds [e.g., 2-pyrrolidone, N-methyl-2-pyrrolidone, cyclohexylpyrrolidone, 2-oxazolidone, and 1,3-dimethyl-2-imidazolizinone]; sulfoxides [e.g., dimethylsulfoxide]; and sulfones [e.g., sulfolane].

Specifically preferable water soluble organic solvent of the present invention are polyhydric alcohols, alkyl ethers of polyhydric alcohols and heterocyclic compounds, and it is preferable to combine 2 or 3 of these solvents.

Water soluble organic solvents which can be used in the present invention are those having a SP value of 18.41 to 30.69 $(MPa)^{1/2}$ selected from the above-mentioned organic solvents.

As water soluble organic solvents having a SP value of 18.41 to 30.69 $(MPa)^{1/2}$ of the present invention, preferably used are ethylene glycol, diethylene glycol, triethylene glycol, diethylene glycol monobutyl ether, triethylene glycol monobutyl ether, triethanolamine and 2-pyrrolidine, and the specifically preferable solvent to be used is diethylene glycol monobutyl ether (having a SP value of 19.437, and a boiling point of 230° C.).

The water soluble organic solvents of the present invention are selected from solvents having a boiling point of at least 120° C. The upper limit of the boiling point is not specifically restricted, but the melting point is preferably not more than 30° C.

Organic particles A of the present invention are water insoluble fine organic particles having the tendency to dissolve or swell in a water soluble organic solvent having a SP value from 18.41–30.69 $(MPa)^{1/2}$ and a boiling point of at least 120° C., exhibiting a glass transition temperature (Tg) of at least 70° C. and an average particle size of at most 100 nm, and further, is a polymer having an average molecular weight of at least 5,000. The particles may be selected from commonly known materials such as polyvinyl chloride, polyvinylidene chloride, polyacrylate, polymethacrylate, elastomer, ethylene-vinylacetate copolymer, styrene-(metha)acrylate copolymer, polyester, polyvinyl ether, polyvinyl acetal, polyamide, polyurethane, polyolefin, SBR, NBR, polytetrafluoroethylene, chloroprene, protein, polysaccharides, rosin ester, and shellac resin. The specifically preferable materials of organic particles A are polyvinylacetal type resins, rosin ester type resins, (metha) acrylate type resins and SBR, and resins comprised of more than 2 monomers with modification or copolymerization. Also, materials may be employed in which a specific modifying group is added to resins or a leaving group is eliminated from resins, more than 2 materials are mixed to form fine organic particles, or more than 2 fine organic particles are mixed.

The term "to dissolve in an organic solvent" in the present invention means that organic particles A and a water soluble organic solvent in the ink comprise a single phase in state of equilibrium. The term "to swell in the organic solvent" means that organic particles A absorb a water soluble organic solvent resulting in an increase of volume. The preferable swelling volume is 2 to 8 times.

Organic particles A of the present invention must be water insoluble so as not to dissolve during ink-jet recording. However, it is allowable for them ed to absorb water as long as the ink absorption rate is not deterred. Water can be absorbed up to 20 weight % of the weight of organic particles A. Further, the amount of organic particles A of the invention needs only to be enough so that organic particles A containing layer is softened after printing with the pigmented ink, and preferably at least 50% to the total solid components in the layer, and more preferably at least 75%.

Further, a cross-linking agent can be added to organic particles A within the range which does not affect the ability of organic particles A to dissolve or swell in the water soluble organic solvents. In the present invention, commonly known cross-linking agents, without regard to being organic or inorganic, can appropriately be used as a cross-linking agent.

Subsequently, organic particles B of the present invention will be described below. Organic particles B of the present invention are defined as fine organic particles comprised of a copolymer having a recurring unit represented by foregoing Formula (1) in an amount of 5 weight % based on the total weight of the copolymer, and exhibiting a glass transition temperature (Tg) of at least 70° C. and an average particle size of at most 100 nm.

The details of the recurring unit represented by foregoing Formula (1) are explained below. From the view point that it is preferable to achieve the effects of the present invention, the recurring unit represented by foregoing Formula (1) of organic particles B is preferably hydrophilic. Specifically, organic particles B are obtained by polymerization of following hydrophilic monomers: acryl type monomers, acrylamide type monomers and/or methacrylamide type monomers, but they are not limited to these in the present invention.

(1)

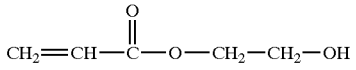

(2)

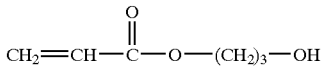

-continued
(3)
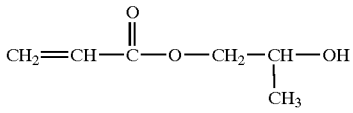
(4)
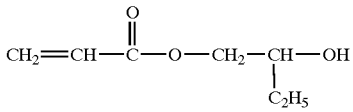
(5)
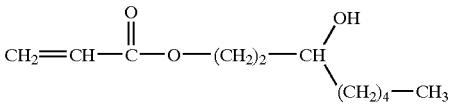
(6)
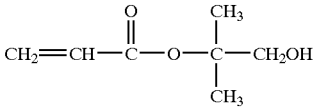
(7)
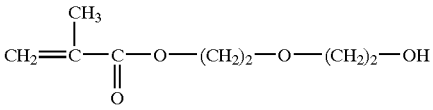
(8)
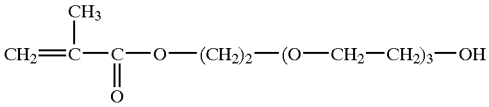
(9)
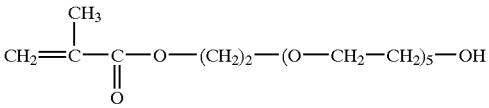
(10)
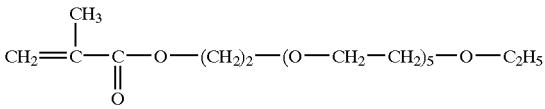
(11)
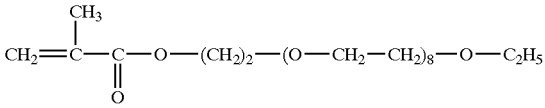
(12)
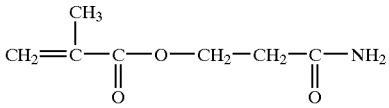
(13)
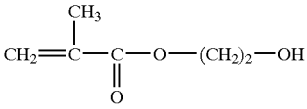
(14)
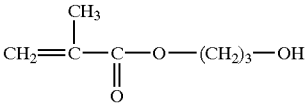
-continued
(15)
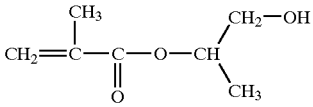
(16)
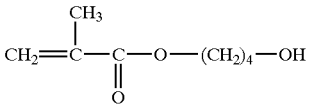
(17)
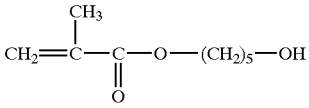
(18)
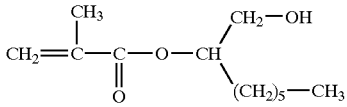
(19)
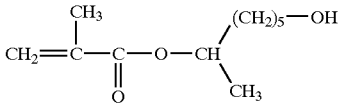
(20)
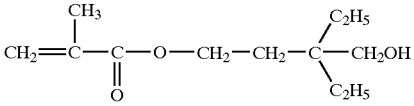
(21)
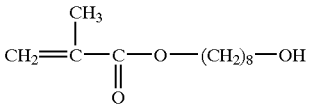
(22)
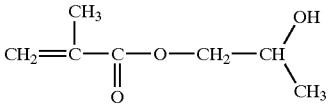
(23)
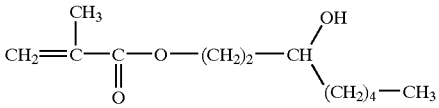
(24)
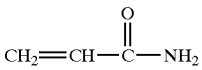
(25)
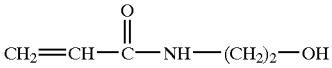
(26)
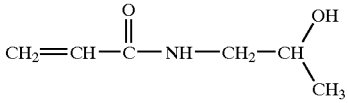
(27)
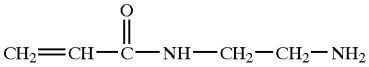
(28)
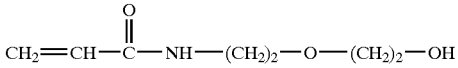

-continued (29)

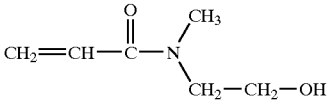

(30)

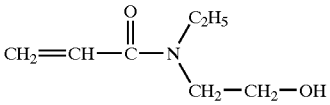

(31)

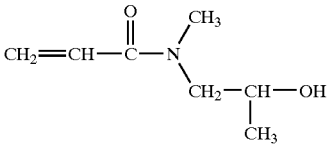

The given hydrophilicity to the recurring unit represented by foregoing Formula (1) may be for each component structure of the substituent groups of X, Y and J forming foregoing Formula (1), but hydrophilicity is preferably given with substituent group Y in the present invention.

As the substituent group used to affect hydrophilicity to foregoing Formula (1), substituent groups having a minus hydrophobic parameter (π) may be employed as described in Yakubutsu no Kozokasseisokan (Doraggudezain to Sayokisaku kennkyu heno Shishin) (Structural Activity Relationship of Drugs: Guide to Drug Design and Action Mechanism), pp. 96 through 103 in Kagaku no Ryoiki, extra publication vol. 122, edited by Kozokasseisokan Kondankai, published by Nankodo Corp., 1980.

Organic particles B of the present invention are necessarily have the specific recurring unit represented by foregoing Formula (1) of at least 5 weight % of the copolymerization components, and preferably at least 10 weight %.

Organic particles B themselves are preferably hydrophilic but not water soluble, and thus, it is preferable that the content is preferably adjusted to be in the range of 10 to 50 weight %.

Examples of the polymers containing at least 5 weight % of the recurring unit as copolymerization components represented by foregoing Formula (1), which are used as component substances of organic particles B of the present invention, are listed below, but the present invention is not restricted to these examples.

L1

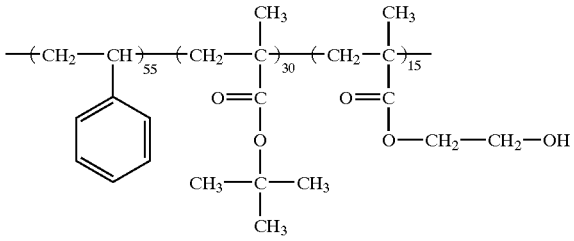

Tg103° C., Average particle size 30 nm

L2

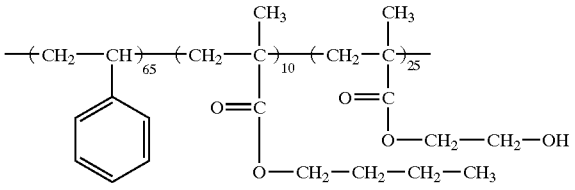

Tg72° C., Average particle size 80 nm

L3

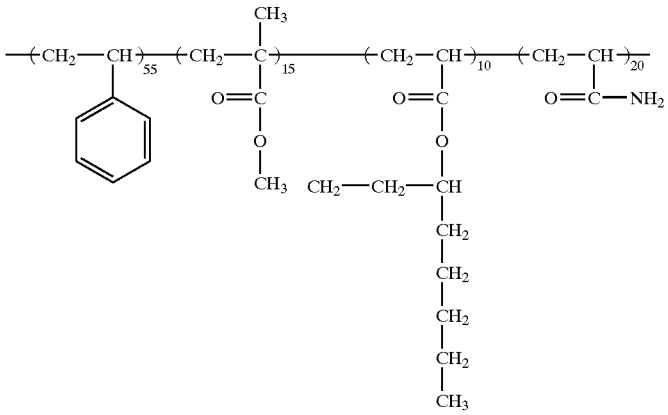

Tg87° C., Average particle size 50 nm

L4

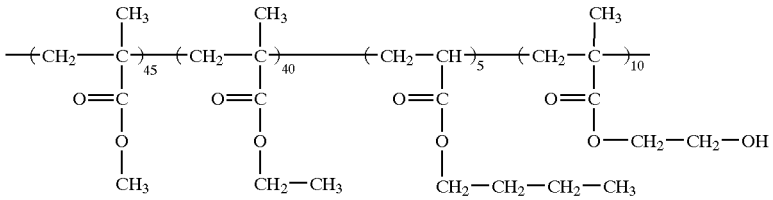

Tg74° C., Average particle size 20 nm

-continued

L5

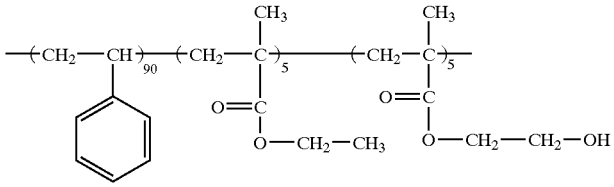

Tg97° C., Average particle size 30 nm

While commonly known polymers having an ethylenic unsaturated group may optionally be selected as other monomer components comprising organic particles B, which may be one of several kinds. Examples of these monomers include alkyl esters and alkyl amides of acrylic acid or methacrylic acid, such as methyl acrylate, methyl methacrylate, ethyl acrylate, ethyl methacrylate, n-butyl acrylate, n-butyl methacrylate, i-butyl acrylate, i-butyl methacrylate, t-butyl acrylate, t-butyl methacrylate, cyclohexyl acrylate, cyclohexyl methacrylate 2-ethylhexyl acrylate, 2-ethylhexyl methacrylate, lauryl acrylate, lauryl methacrylate, styrene, vinyltoluene, α-methylstyrene, vinyl acetate, acrylonitrile, methacrylonitrile, or acrylic acid, methacrylic acid, fumalic acid, itaconic acid, maleic acid, or dimethylaminomethylacrylate, diethylaminomethylacrylate, dibutylaminomethylacrylate, dihexylaminomethylacrylate, dimethylaminoethylacrylate, diethylaminoethylacrylate, (t-butyl)aminoethylacrylate, diisohexylaminoethylacrylate, dihexylaminopropylacrylate, di(t-butyl)aminohexylacrylate. Of these, styrene, methylmethacrylate and n-butylacrylate are preferable.

Organic particles B of the present invention preferably comprise a coating composition prepared as a water-based emulsion. In this case, the ionic property of the emulsion is preferably the same as that of the coating composition or is nonionic. Also, the ionic property of the coating composition containing organic particles B is preferably the same as those of other layer coating compositions or is nonionic. Specifically preferable is that the ionic property of organic particles B and all coating compositions is either cationic or nonionic.

Usually ink-jet recording sheets are used at room temperature, but the storage condition before usage is not restricted to room temperature, and often is subjected to very high temperatures in an enclosed vehicle, especially during summer. Therefore, it is desired to be usable without problems that the ink-jet recording sheet can safely pass through such conditions. Thus, the glass transition temperature (Tg) of organic particles B is necessarily at least 70° C., and is preferably at least 80° C., and more preferably between 90–120° C.

In cases when the glass transition temperature (Tg) of foregoing organic particles A and organic particles B is less than 70° C., the organic particles tend to fuse or coagulate due to excessive heat, resulting in reduction of ink absorption rate due to shrinkage or a decrease of voids on the surface of the recording sheet.

Herein, Tg of the polymer comprised of component substances of the fine organic particles of the present invention can be determined by calculation of the Tg of the homopolymer of the monomer as a copolymerization component, and by the weight ratio based on the component ratio of the monomers. For example, Tg of a polymer comprising styrene (Tg of homopolymer=100° C.=373 K) and n-butylacrylate (Tg of homopolymer=−54° C.=219 K) at a ratio of 4:1 (weight ratio) is determined as $1/\{\cdot(1/373\ K)\times 4/5+(1/219\ K)\times 1/5\}=327\ K$ (=54° C.). Measured values of Tg of a homopolymer of a monomer are described in POLYMER HANDBOOK published by A Wiley-Interscience Publication, Co.

One measurement method of the average particle size is described below. The cross section or surface of the fine organic particles containing layer is observed using an electron microscope, and each diameter of many randomly selected particles is determined, after which the simple average (or the number average) is obtained as the average particle size. Herein, each particle diameter is represented by the diameter of a circle having the same projected area as that of the particle. Or, another method is that the average particle size is determined by the particle size distribution measurement using a laser diffraction scattering method, after dispersing organic particles A or B into an optional dispersion medium. The shape of organic particles A or B of the invention is not necessarily spherical, and may be needle-like or plate-like. The particle size is determined by conversion of the volume to that of an equivalent sphere.

Further, the average particle size of organic particles A or B must not be more than 100 nm, and preferably not more than 60 nm, and more preferably 20–40 nm. Organic particles B of the present invention are preferably synthesized in water with the commonly known emulsion polymerization method. The particle size can be adjusted, in the foregoing range of about 20–100 nm with any of the commonly known methods adjusting the emulsifying agent and its quantity and the monomer component.

In order to predominantly obtain the desired effects of the present invention, the content of organic particles A or B in the surface porous layer provided on the surface of the porous layer is preferably 50 to 90 weight %. From the viewpoint of effectively preventing fusion of fine organic particles with each other in the surface porous layer and increasing the ink absorption rate, fine inorganic particles can be contained the same as those used in the porous layer, to be described later.

The ink-jet recording sheet of the present invention features a surface porous layer containing foregoing organic particles A or organic particles B. The surface porous layer of the present invention is not restricted to the outermost layer, and is not specifically limited as long as the configuration is capable of obtaining the desired effects of the present invention.

Examples of a preferable configuration are clearly specified below, but the layer structure of the present invention is not limited to these examples.

1. A configuration comprising a support having a porous ink absorbing layer (or a porous layer) and an upper layer (or a surface porous layer) containing organic particles A or the organic particles B thereon.

2. A configuration comprising a support featuring a void type ink absorbing layer thereon, provided with a layer containing organic particles A or organic particles B thereon, and further provided thereon is a thin layer to improve surface property.

3. A configuration comprising a support featuring a void type ink absorbing layer thereon, provided with a layer containing organic particles A or organic particles B thereon, and further provided thereon is a thin layer having the ultraviolet absorbing function to block harmful light.

4. A configuration comprising a support featuring a void type ink absorbing layer thereon, provided with a layer containing organic particles A or organic particles B thereon, and further provided thereon is a layer containing a matting agent.

5. A configuration comprising a support featuring a void type ink absorbing layer thereon, provided with a layer containing organic particles A or organic particles B thereon, and further provided thereon is a peelable layer.

The specifically preferred configuration is the above-described examples in item 1, which has a layer containing organic particles A or organic particles B being the outermost layer, by which the desired effects of the present invention are efficiently obtained.

The organic particles containing surface porous layer indicates a layer which contains organic particles in an effective amount to provide the effect of the present invention. A layer containing only a small amount, which is not sufficient to obtain the effect of the present invention, is not considered to be an organic particles containing surface layer. When the surface porous layer structure of the ink-jet recording sheet of the present invention has a multiple structure and the content of the organic particles is changed from the outer layer to the inner layer(s), the layer containing the organic particles in an amount of at least 50 weight % of the total weight of the layer is considered to be an organic particles containing surface layer.

The surface porous layer containing organic particles A or organic particles B of the present invention may contain the same fine inorganic particles or a binder component as used in the ink absorbing layer to be described later.

In the present invention, the feature is that at least one layer of the surface porous layer or the porous layer contains a compound containing a polyvalent metal element.

The polyvalent metal compounds suitable for the present invention are not specifically limited, and for example, listed may be sulfates, chlorides, nitrates and acetates of $Mg_2^+$, $Ca_2^+$, $Zn_2^+$, $Zr_2^+$, $Ni_2^+$ and $Al_3^+$. Generally, there are many of these water soluble compounds exhibiting functions to enhanced light stability, reduced bleeding and water resistance.

Of the foregoing polyvalent metal compounds in the present invention, a zirconium and aluminum containing compounds are preferred.

Listed as specific examples of zirconium atom containing compounds which are suitable for the present invention are zirconium difluoride, zirconium trifluoride, zirconium tetrafluoride, hexafluorozirconate (for example, potassium salts), heptafluorozirconate (for example, sodium salts, potassium salts, and ammonium salts), octafluorozirconate (such as, lithium salts), zirconium fluoride oxide, zirconium dichloride, zirconium trichloride, zirconium tetrachloride, hexachlorozirconate (such as, sodium salts and potassium salts), zirconium oxychloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfate trihydrate, potassium zirconyl sulfate, zirconium selenate, zirconium nitrate, zirconyl nitrate, zirconium phosphate, zirconyl carbonate, ammonium zirconyl carbonate, zirconium acetate, zirconyl acetate, ammonium zirconyl acetate, zirconyl lactate, zirconyl citrate, zirconyl stearate, zirconyl phosphate, zirconyl phosphate, zirconium oxalate, zirconium isopropionate, zirconium butyrate, zirconium acetylacetonate, acetyl acetone zirconium butyrate, zirconium stearate butyrate, zirconium acetate, bis(acetylacetonato)dichlorozirconium, and tris (acetylacetonato)chlorozirconium.

Of these compounds, preferred are zirconyl carbonate, ammonium zirconyl carbonate, zirconyl acetate, zirconyl nitrate, zirconium oxychloride, zirconium lactate, and zirconyl citrate, with the most preferred compounds being ammonium zirconyl carbonate, zirconyl oxychloride and zirconyl acetate. Examples of commercial compounds are Zirconyl Acetate ZA (product name) and Zirconyl Oxychloride (product name) produced by Daiichi Kidorui Kagaku K. K.

Zirconium atom containing compound may be used alone or in combination of 2 or more compounds. When more than 2 compounds are used, a desired effect of restrained bronzing (a phenomenon of metallic luster resulting in acceleration of crystallization of dyes in ink) which is thought to be readily caused by use of a zirconium atom containing compound.

Zirconium atom containing compounds may be incorporated into the coating compositions to form a surface porous layer or a porous layer of the present invention, or can be applied onto the porous layer after being coated and dried. The foregoing compounds, containing zirconium atoms may be dissolved in water, organic solvents, or a solvent mixture consisting of water and the organic solvents, are dispersed as fine particles, employing a wet crushing method such as a sand mill or a method such as emulsifying dispersion. When the ink absorbing layer is comprised of a plurality of layers, the resulting solution or dispersion may be added to only one layer, at least two layers, or all of the coating forming layers.

When Zirconium atom containing compounds is applied onto the porous layer being coated and dried beforehand, then the compounds are added employing an overcoating method, it is preferable that they are uniformly dissolved in a solvent and the resulting solution is then applied onto the surface porous layer or onto the porous layer.

Listed as specific examples of aluminum atom containing compounds which are suitable for the present invention are aluminum fluoride, hexafluoroaluminate (for example, potassium salts), aluminum chloride, basic aluminum chloride (for example, polyaluminum chloride), tetrachloroaluminate (for example, sodium salts), aluminum bromide, tetrabromoaluminate (for example, potassium salts), aluminum iodide, aluminate (for example, sodium salts, potassium salts, and calcium salts), aluminum chlorate, aluminum perchlorate, aluminum thiocyanate, aluminum sulfate, basic aluminum sulfate, aluminum potassium sulfate (alum), aluminum ammonium sulfate (ammonium alum), aluminum sodium sulfate, aluminum phosphate, aluminum nitrate, aluminum hydrogenphosphate, aluminum carbonate, aluminum silicate polysulfate, aluminum formate, aluminum acetate, aluminum lactate, aluminum oxalate, aluminum isopropionate, aluminum butyrate, ethyl acetate aluminum diisopropionate, aluminum tris(acrtylacetonate), aluminum tris(ethylacetoacetate), and aluminum monoacetylacetonatebis(ethylacetoacetate). Of these, preferred are aluminum chloride, basic aluminum chloride, aluminum sulfate, basic aluminum sulfate, and basic aluminum silicate sulfate, while specifically preferred are basic aluminum chloride and basic aluminum sulfate.

The compounds containing zirconium atoms or aluminum atoms in the present invention may preferably be incorporated in the amount of 0.01–5 g/m$^2$ of the ink-jet recording sheet paper, more preferably 0.05–2 g/m$^2$, and still more preferably 0.1–1 g/m$^2$. It is preferred that the effects of the present invention are predominantly exhibited when the amount of each compound is in the above range. Further, in cases when the oxides of the respective compounds containing zirconium atoms or aluminum atoms mentioned above are employed, a large amount of these oxides is necessarily added to obtain the desired effects.

Next, a porous layer will be described.

The ink-jet recording sheet of the present invention is provided with at least one porous layer.

Generally, an ink absorbing layer is divided mainly into two types, a swelling and a void type. A void type layer is formed by coating of a water soluble binder alone or in a combination of them, such as gelatin, polyvinyl alcohol, polyvinyl pyrrolidone, and polyethylene oxide, to obtain an ink absorbing layer.

As a void type layer, the fine particles and water soluble binders are coated after mixing, and a layer exhibiting high gloss is preferred. As fine particles, alumina or silica is preferably used, and specifically silica having a particle size of at most 0.1 $\mu$m is preferred. As a water soluble binder, gelatin, polyvinyl alcohol, polypyrrolidone and polyethylene oxide may preferably be used alone or in combination.

Of these two types of ink absorbing layers, a recording material featuring a higher ink absorption rate is suitable to adapt to continuous high speed printing. From this point of view, the porous layer of the present invention is a void type.

In the followings, a void type ink absorbing layer (or a porous layer) will be described in more detail.

A void layer is formed primarily by weak coagulation of a water soluble binder and fine inorganic particles. Heretofore, various methods to form voids in film are known, for example: a method to form voids with phase separation of polymers mutually during the drying process, after application of a uniform coating composition containing at least two polymers onto a support; a method to form voids with dissolution of fine solid particles by soaking ink-jet recording sheet paper in water or appropriate organic solvent after coating and drying of the coating composition's fine solid particles and the hydrophilic resin or hydrophobic resin onto a support; a method to form voids in film by foaming of the material during the drying process after application of the coating composition containing a compound having the capability to foam during film formation; a method to form voids in fine porous particles or among fine particles with coating of the coating compound containing porous fine solid particles and a hydrophilic binder on a support; a method to form voids among fine solid particles with application of the coating composition containing fine solid particles and/or fine particle oil drops having a volume of more than or equivalent to that of the hydrophilic binder and a hydrophilic binder on a support. Specifically preferred is to form voids containing various inorganic fine solid particles of an average particle size of at most 100 nm in the void layer in the present invention.

Cited as examples-of the fine inorganic particles used for the above purpose may be white inorganic pigments such as light precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The average diameter of the fine particles may be calculated as follows. The particles themselves, or the cross-section or surface of a void layer, is observed employing an electron microscope, and each diameter of 1,000 randomly selected particles is determined. The simple average (the numerical average) is obtained as the diameter of the particles based on the determined diameter. Herein, each particle diameter is represented by the diameter of a circle having the same projection area as that of the particle.

Fine solid particles selected from silica, alumina and alumina hydrate are preferably used as fine inorganic particles.

Silica synthesized with a typical wet method, colloidal silica and silica synthesized with a gas phase method may be employed as usable silica in the present invention, and further, specifically preferable is fine particle silica in the present invention, colloidal silica and silica synthesized with a gas phase method. Of these, silica synthesized with a gas phase method is preferable at a high void ratio as can be obtained. Alumina and alumina hydrate may be crystalline or amorphous, and optional shapes of undetermined form, spherical or needle-shaped may also be used.

The particle size of fine inorganic particles is preferably not more than 100 nm. For example, in case of the foregoing silica synthesized via a gas phase method, the average particle size of primary particles of fine inorganic particles dispersed in primary particle state (the particle size in the state of a dispersed solution before coating) is preferably at most 100 nm, more preferably 4–50 nm, and still more preferably 4–20 nm.

As the most preferably used silica synthesized via a gas phase method having an average particle size of primary particles of 4–20 nm, Aerosil produced by Nippon Aerosil Co., Ltd. is commercially available on the market. This fine particle silica synthesized by a gas phase method is relatively easily dispersed into primary particles in water using Jet-stream Inductor Mixer manufactured by Mitamura Riken Kogyo Co., Ltd., employing suction dispersion.

Water soluble binders may be incorporated into the porous layer of the ink-jet recording sheet of the present invention. Listed as examples of the water soluble binders are: polyvinyl alcohol, gelatin, polyethylene oxide, polyvinylpyrrolidone, polyacrylic acid, polyacryl amide, polyurethane, dextran, dextrin, carrageenan ($\kappa$, $\iota$, $\lambda$), agar, pullulan, water soluble polyvinyl butyral, hydroxyethyl cellulose, and carboxymethyl cellulose. These water soluble binders may be used in combination of more than two kinds.

A water soluble binder preferably used in the present invention is polyvinyl alcohol.

Polyvinyl alcohols employed in the present invention include common polyvinyl alcohol prepared by hydrolyzing polyvinyl acetate, and in addition, modified polyvinyl alcohol such as terminal cation-modified polyvinyl alcohol and anion-modified polyvinyl alcohol having an anionic group.

The average degree of polymerization of polyvinyl alcohol prepared by hydrolyzing vinyl acetate is preferably 1,000 or more, and is more preferably from 1,500–5,000. Further, the saponification ratio is preferably from 70–100%, and is more preferably from 80–99.5%.

Cation-modified polyvinyl alcohols are, for example, polyvinyl alcohols having a primary to a tertiary amino group, or quaternary ammonium grouping the main chain or side chain of the foregoing polyvinyl alcohols as described in JP-A 61-10483, and are obtained upon saponification of ethylenic unsaturated monomers having a cationic group and vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxyethyltrimethylammonium chloride, trimethyl-(2-methacryamidopropyl)ammonium chloride, and N-(1,1-dimethyl-3-dimethylaminopropyl)acrylamide.

The content ratio of monomers containing a cation-modified group of the cation-modified polyvinyl alcohol is 0.1–10 mol % to the vinyl acetate, and is preferably 0.2–5 mol %.

Listed as anion-modified polyvinyl alcohols are, for example, polyvinyl alcohols having an anionic group as described in JP-A 1-206088, copolymers of vinyl alcohols and vinyl compounds having a water solubilizing group as described in JP-A 61-237681 and 63-307979, and modified polyvinyl alcohols containing a water solubilizing group, as described in JP-A 7-285265.

Further, listed as nonion-modified polyvinyl alcohols are, for example, polyvinyl alcohol derivatives in which a polyalkylene oxide group is added to a part of polyvinyl alcohol as described in JP-A 7-9758, and block copolymers of vinyl compounds having a hydrophobic group and polyvinyl alcohols as described in JP-A 8-25795. Further, various types of polyvinyl alcohols, in which the degree of polymerization or modification differs, may be employed in a combination of at least two types.

Use of polyvalent metal compounds as a dye fixing agent is a feature in the present invention, but the simultaneous use of cationic polymers with these compounds is not prohibited as long as it is in the range to accomplish the objects and effects of the present invention.

Examples of such cationic polymers are; polyethyleneimines, polyallylamines, polyvinylamines, dicyandiamide-polyalkylenepolyamine condensates, polyalkylenepolyamine-dicyandiamideammoniumsalt condensates, dicyandiamide-formalin condensates, addition polymers of epichlorohydrin-dialkylamine, polymers of diallyldimethylammoniumchloride, copolymers of diallyldimethylammoniumchloride-$SO_2$, polyvinylimidazoles, copolymers of vinylpyrrolidone-vinylimidazole, polyvinylpyridine, polyamidines, chitosan, cationized starch, polymers of vinylbenzyltrimethylammoniumchloride, polymers of (2-methacroiloxyethyl)trimethylammoniumchloride and polymers of dimethylaminoethylmethacrylate.

Other examples are cationic polymers described in articles of KAGAKU KOGYO JIHO (Chemical Industry Review) on Aug. 15, 1998, and on Aug. 25, 1998, and polymer dye fixing agents described in "KOBUNSHI YAKUZAI NYUMON" (Introduction of Polymer Medicines), pg. 787, (1992), published by Sanyo Chemical Industries, Ltd.

The added amount of fine inorganic particles, employed in the porous layer, varies largely depending on the desired ink absorption capacity, the void ratio of the void layer, the types of fine inorganic particles, and the types of water soluble binders, but is generally from 5–30 g/m$^2$ of the recording sheet, and is preferably from 10–25 g/m$^2$.

The ratio of fine inorganic particles to a water soluble binder, employed in the porous layer, is generally from 2:1 to 20:1, and is preferably from 3:1 to 10:1.

The porous layer may contain a cationic water soluble polymer having a quaternary ammonium salt group in the molecule, which is generally employed from 0.1–10 g per m$^2$ of the recording sheet, and is preferably from 0.2–5 g.

The total amount of the voids (meaning void volume) in the void layer is preferably at least 20 ml per m$^2$ of the recording sheet. In cases when the void volume is less than 20 ml/m$^2$, ink absorbability is adequate with only low ink volume at printing, but problems of lowered image quality or delayed ink drying tend to result in incomplete ink absorption at a high volume of ink.

In the void layer having ink retention ability, the void volume to the volume of the solids is defined as the void ratio. It is preferred to maintain a void ratio of at least 50% in the present invention, effectively forming voids without unnecessarily thick layer.

As a void type ink absorbing layer, other than forming an ink absorbing layer using fine inorganic particles, the ink absorbing layer can be formed using a coating composition containing a polyurethane resin emulsion in combination with a water soluble epoxy compound and/or an acetoacetylated polyvinyl alcohol, and further an epichlorohydrin polyamide resin. A polyurethane resin emulsion in this case is preferably a polyurethane emulsion having a particle diameter of 3.0 $\mu$m, in which the particles have a polycarbonate chain or a polycarbonate chain and polyester chain. It is more preferable that the polyurethane resin of the polyurethane resin emulsion has a sulfon group in the molecule and also an epichlorohydrin polyamide resin and a water soluble epoxy compound and/or an acetoacetylated vinyl alcohol. Herein, the polyurethane resin is obtained with reaction of polyol having polycarbonate polyol or polycarbonate polyol and/or polyester polyol, and an aliphatic isocyanate compound. It is presumed that slight coagulation is formed in the ink absorbing layer using the foregoing polyurethane resin, and based on this, the voids having ink absorbing capability are formed to produce images.

It is preferred to use a hardening agent in the present invention. The hardening agent may be added at any appropriate time during production of the ink-jet recording sheet, and can, for instance, be added into the coating composition to form an ink absorbing layer.

In the present invention, a method to apply a hardening agent to a water soluble binder may employed by itself, but is preferably employed in combination with a method adding the foregoing hardening agent into the coating composition to form a porous layer.

Usable hardening agents for the present invention are not limited as long as they cause a hardening reaction in a water soluble binder, and preferably used is boric acid and salts thereof, and in addition other commonly known compounds may be used. Generally, hardening agents are compounds having a group capable of reacting with a water soluble binder, or accelerating a reaction between different groups contained in the water soluble binder, and are appropriately used depending on the type of a water soluble binder. Examples of hardening agents are epoxy type hardening agents (e.g., diglycidyl ethyl ether, ethylene glycol diglycidyl ether, 1,4-butanediol diglycidyl ether, 1,6-diglycidylcyclohexane, N,N-diglycidyl-4-glycidyloxyaniline, sorbitol polyglycidyl ether, and glycerol polyglycidyl ether); aldehyde type hardening agents (e.g., formaldehyde and glyoxal); active halogen type hardening agents (e.g., 2,4-dichloro-4-hydroxy-1,3,5-s-trizine); and active vinyl type compounds (e.g., 1,3,5-trisacryloyl-hexahydro-s-triazine, and bisvinylsulfonyl methyl ether); and aluminum alum.

Boric acid and salts thereof refer to oxygen acid having a boron atom as the central atom and/or salts thereof, and specifically include orthoboric acid, diboric acid, metaboric acid, tetraboric acid, pentaboric acid, and octaboric acid, and salts thereof.

Hardening agents of boric acid and salts thereof having a boron atom may be used in the form of a solution thereof, by itself or in a mixture of two or more kinds. Specifically preferred is a mixed solution of boric acid and borax.

Only a boric acid solution and a borax solution are each added in relatively diluted solutions, but a denser solution can be obtained by mixing both solutions, resulting in a concentrated coating composition. Further, there is a benefit by adjusting the pH of the added solution to a desirable level. The total added amount of the foregoing hardening agents is preferably 1–600 mg/g of the foregoing water soluble binder.

Various additives, other than the foregoing additives, the present invention may be incorporated into the porous layer and other layers as required. Examples include numerous additives known in the art, for example, polystyrene, polyacrylic acid esters, polymethacrylic acid esters, polyacrylamides, polyethylene, polypropylene, polyvinyl chloride, polyvinylidene chloride, and copolymers thereof; minute organic latex particles of urea resins or melamine resins; various types of anionic, cationic, nonionic or betaine type surface active agents; ultraviolet absorbing agents described in JP-A 57-74193, 57-87988, and 62-261476; anti-fading additives described in JP-A 57-74192, 57-87989, 60-72785, 61-146591, 1-95091, and 3-13376; fluorescent brightening agents described in JP-A 59-42993, 59-52689, 62-280069, 61-242871, and 4-219266; pH adjusting agents such as sulfuric acid, phosphoric acid, citric acid, sodium hydroxide, potassium hydroxide, and potassium carbonate; antifoaming agents, antiseptic agents, viscosity thickening agents, antistatic agents, and matting agents.

The porous layer may be comprised of more than two layers. In that case, the composition of the multiple layers may be the same or differ from each other.

Supports usable in the present invention are common ones for an ink-jet recording sheet, and employed as desired. A water absorptive support may be employed, but a non-water absorptive support is preferably employed. Namely, it is presumed that the notable effects of the present invention can be obtained due to the effective action to dissolve fine organic particles in a large volume of a water soluble organic solvent retained in the recording sheet, the solvent of which is contained in the pigmented ink, in cases where the support is non-water absorptive compared to being water absorptive. Specifically, use of a "support not absorbing a water soluble solvent contained in pigment ink" is preferred, however, it is supposed that the notable effects of the present invention can be obtained by using a non-water absorptive support.

As the water absorptive support, paper supports, cloth and wood supports are usable. Paper supports are preferably used because of their high water absorption and low cost of the base material. Raw material used for a paper support may contain chemical pulp such as LBKP and NBKP, mechanical pulp such as GP, CGP, RMP, TMP, CTMP, CMP, and PGW, recycled paper pulp such as DIP. When required, various kinds of fibrous material such as synthetic pulp, synthetic fibers or inorganic fibers may also be used as a raw material.

It is also allowable to add conventionally known additives to the paper support. Such additives include sizing agents, pigments, paper-strengthening agents, fixing agents, fluorescent brightening agents, moisture-retention agents, and softening agents.

The paper support can be manufactured employing conventional paper making equipment such as a Fourdrinier machine, a cylinder machine, and a twin wire machine after applying several kinds of additives to the above-listed fibers, such as wood pulp. The paper support may be sized and pressed with starch or polyvinyl alcohol during or after manufacture as required. Several types of coatings or calendering treatments may also be conducted.

Preferably used non-water absorptive supports in the present invention may be either transparent or opaque supports. Transparent supports include film containing resins such as polyester type resin, diacetate type resin, triacetate type resin, acryl type resin, polycarbonate type resin, polyvinyl chloride type resin, polyimide type resin, cellophane and Celluloid. Among other factors, a support exhibiting the property to resist radiation heat when used for an over-head projector is preferably used, for which polyethylene terephthalate is specifically preferable. The thickness of these transparent supports is preferably 50–200 $\mu$m.

Listed as preferable opaque supports are, for example, a resin coated paper having a polyolefin coated layer containing white pigments on at least one side of the paper base (so-called RC paper), and what is known as white PET, comprised of polyethylene terephthalate added white pigments, such as barium sulfate.

It is preferable that the supports are subjected to a corona discharge treatment or a subbing layer treatment before coating of a porous layer in order to strengthen the adhesive force between the foregoing supports and the porous layer. Further, the ink-jet recording sheet of the present invention is not necessarily colorless, but may be colored.

For the ink-jet recording sheet of the present invention, paper supports prepared by covering both sides of the paper base with polyolefin resins are preferable, because the resulting recorded image is close to conventional photographic quality, and furthermore, the high image quality is obtained at a relatively low cost.

Polyethylene laminated onto paper supports will be described below. Paper employed in the supports is made by employing wood pulp as the main raw material, and if desired, synthetic pulp such as polypropylene or synthetic fiber such as nylon and polyester. Employed as the wood pulp may be any of LBKP, LBSP, NBKP, NBSP, LDP, NDP, LUKP, and NUKP. However, it is preferable that LBKP, NBSP, LBSP, NDP, and LDP comprising short fiber component in a relatively large amount are preferably employed. Incidentally, the ratio of LBSP and/or LDP is preferably 10 to 70 weight %.

Preferably employed as the foregoing pulp is chemical pulp (sulfate pulp and sulfite pulp) comprising minimal impurities. Further, also useful is pulp which has been subjected to a bleaching treatment to enhance whiteness. Suitably incorporated into the paper base may be sizing agents such as higher fatty acids and alkylketene dimers; white pigments such as calcium carbonate, talc, and titanium oxide; paper strength enhancing agents such as starch, polyacrylamide, and polyvinyl alcohol; fluorescent brightening agents; moisture retention agents such as polyethylene glycols; dispersing agents; and softeners such as quaternary ammonium.

The degree of water freeness of pulp employed for paper making is preferably between 200 and 500 ml based on CSF Specification. Further, the sum of the weight % of 24-mesh residue and the weight % of 42-mesh residue regarding the fiber length after beating, specified in JIS P-8207, is preferably 30–70%. Further, the weight % of 4-mesh residue is preferably not more than 20 weight %.

The basis weight of the paper base is preferably 50–250 g, and is most preferably 50–200 g. The thickness of the paper base is preferably 40–250 $\mu$m.

During the paper making stage, or alternatively after paper making, the paper base may be subjected to a calendering treatment to result in excellent smoothness. The density of the paper base is generally 0.7–1.2 g/m$^3$ (JIS P-8118). Further, the stiffness of the paper base is preferably 20–200 g under the conditions specified in JIS P-8143. Surface sizing agents may be applied onto the paper base surface.

The pH of the paper base, when determined employing a hot water extraction method specified in JIS P-8113, is preferably 5–9.

Polyethylene, which covers both surfaces of the paper, is comprised mainly of low density polyethylene (LDPE) and/or high density polyethylene (HDPE), but it is also possible to employ slight amounts of LLDPE and polypropylene.

Specifically, rutile or anatase type titanium oxide is preferably incorporated into the polyethylene layer on the porous layer side so as to improve opacity and whiteness, as widely conducted in photographic print paper production. The content ratio of titanium oxide is commonly 3–20 weight % with respect to the polyethylene, and is preferably 4–13 weight %.

The polyethylene coated paper may be used in the present invention as a glossy paper, or a matte surface or silk surface paper formed under so-called embossing during melt extrusion coating of the polyethylene onto the paper base, again as is conducted in photographic print paper production. The water content of the paper base of the foregoing polyethylene coated paper is preferably maintained in 3 to 10 weight % range.

It is possible to employ a suitable method selected from those known in the art, by applying various types of porous layers such as void layers and sublayers of the ink-jet recording paper of the present invention, which are provided as desired, onto a support. The preferred methods are such that the coating composition constituting each layer is applied onto a support and subsequently dried. In this case, it is possible to simultaneously apply at least two layers onto the support, and simultaneous multiple layer coating is particularly preferred in which all hydrophilic binder layers are coated simultaneously.

Employed as coating methods may be a roll coating method, a rod bar coating method, an air knife coating method, a spray coating method, and a curtain coating method. However, preferably employed is the extrusion coating method employing a hopper, described in U.S. Pat. No. 2,681,294.

When images are recorded employing the ink-jet recording sheet of the present invention, a recording method, employing a water-based ink, is preferably utilized.

The water-based ink, as described herein, refers to a recording liquid comprised of colorants, liquid media and other additives described below.

Employed as the colorants are direct dyes, acidic dyes, basic dyes, reactive dyes, water-soluble food dyes, or water-dispersible pigments, which are commonly known in the art of ink-jet printing. Above all, specifically preferable colorants in the ink are phthalocyanine dyes, which are widely used as cyan dyes.

Listed as solvents of the water-based ink are water and various water-soluble organic solvents, including for example, alcohols such as methyl alcohol, isopropyl alcohol, and butyl alcohol, t-butyl alcohol, and i-butyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; polyhydric alcohols such as ethylene glycol, propylene glycol, butylene glycol, triethylene glycol, 1,2,6-hexanetriol, thioglycol, hexylene glycol, diethylene glycol, glycerin, and triethanolamine; and lower alkyl ethers of polyhydric alcohols such as ethylene glycol methyl ether, diethylene glycol methyl (or ethyl) ether, and triethylene glycol monobutyl ether.

Of these water soluble organic solvents, preferred are polyhydric alcohols such as diethylene glycol, triethanolamine, and glycerin, and lower alkyl ethers of polyhydric alcohols such as triethylene glycol monobutyl ether.

Listed as other water-based ink additives are, for example, pH adjusting agents, metal sequestering agents, biocides, viscosity modifiers, surface tension controlling agents, wetting agents, surface activating agents, and rust inhibiting agents.

In order to improve the wettability of the water-based ink of the recording sheet, the water-based ink generally exhibits a surface tension in the range of 25–60 mN/m at 20° C., and preferably in the range of 30–50 mN/m.

Printers usable in the present invention are not specifically restricted as long as they are composed of a recording medium tray, a sheet transfer system, and an ink cartridge with an ink-jet print head, but the preferable printer is a line of printers composed of a section to hold a recording sheet roll, a sheet roll transfer system, an ink-jet print head, a cutter, and when desired, a heating area or a pressing area, and a recording print container. The ink-jet print head used may be either an on-demand type or a continuous type. Further, for a discharge method, employed may be the following methods such as an electromechanical transducing method (e.g., single cavity type, double cavity type, bender type, piston type, share mode type, and shared wall type); an electrothermal transducing method (e.g., thermal ink-jet type and bubble jet (R) type); an electrostatic suction method (e.g., electric field control type, slit jet type) or an electric discharge method (e.g., spark jet type). The preferred method is an electromechanical transducing method, but any ejecting methods may be employed.

EXAMPLES

The present invention will be further explained based on examples on the following paragraphs, but it is not limited to these examples.

Preparation of an Ink-Jet Recording Sheet

Ink-jet recording sheets 1 through 10 were prepared in compliance with the following steps.

Preparation of Ink-Jet Recording Sheet 1

The 45° C. coating composition of the porous layer 1 was applied onto a paper support (having a thickness of 240 μm) prepared by coating polyethylene onto both sides of the paper base, with a wire bar method, and subsequently dried and kept in a 40° C. and 80% RH thermostatic chamber for 12 hrs, whereby Ink-jet recording sheet 1 was prepared, for a thickness after drying being 35 μm. In ink absorbing layer 1 of Ink-jet recording sheet 1, coating was conducted so as to contain 18 g/m$^2$ of fine particle silica by a gas phase method (QS-20, produced by Tokuyama Corporation), employing 2.0 g/m$^2$ of a cationic polymer, 2.3 g/m$^2$ of polyvinyl alcohol (PVA235, produced by Kuraray Co., Ltd.), and 0.6 g/m$^2$ of boric acid.

Chemical Formula

C-1

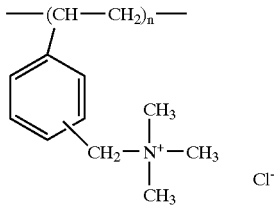

Preparation of Ink-Jet Recording Sheet 2

A 45° C. coating composition for a surface porous layer was applied with a wire bar coating method onto foregoing porous layer 1 of Ink-jet recording sheet 1, and subsequently dried and kept in a 40° C. and 80% RH thermostatic chamber for 12 hrs., whereby Ink-jet-recording sheet 2 was prepared. In the surface porous layer of Ink-jet recording sheet 2, coating was conducted to contain 0.5 g/m$^2$ of the following fine organic particle emulsion (L-1), employing 0.25 g/m$^2$ of fine particle silica by a gas phase method (QS-20, produced by Tokuyama Corporation), and 0.05 g/m$^2$ of acryl type emulsion (at average particle size: 30 nm, Tg: at −30° C.).

Preparation of Fine Organic Particle Emulsion (L-1)

Steariltrimethylammonium chloride as an emulsifying agent was added to monomers of n-butylacrylate: styrene: 2-hydroxyethylmethacrylate: t-butylmethacrylate= 10:50:20:20 (weight ratio), after which an aqueous solution of 2,2'-azobis-4-cyanovaleric acid of a polymerization initiator was continuously added over 30 min. and thus the reaction was continued for 4 hrs. to obtain fine organic particle emulsion (L-1) having a Tg of 76° C. and an average particle size of 30 nm.

Preparation of Ink-Jet Recording Sheets 3 through 9

Ink-jet recording sheets 3 through 9 were prepared in the same manner as preparation of Ink-jet recording sheet 2 except that the type and added amount of a cationic polymer and the kind and added amount of a polyvalent metal compound in the lower porous layer were changed or added as described in Table 1.

The details of the abbreviated names of cationic polymers and polyvalent metal compounds described in Table 1 are as follows.

C-2: PAS-J-81, produced by Nitto Boseki Co., Ltd.

C-3: PAA-3HCL, produced by Nitto Boseki Co., Ltd.

Paho: polyaluminum hydrate, produced by Asada Kagaku Co., Ltd.

Preparation of Ink-Jet Recording Sheet 10

Ink-jet recording sheet 10 was prepared in the same manner as foregoing Ink-jet recording sheet 2 except that the lower porous layer 1 was replaced by a porous layer 2 comprising 18.0 g/m$^2$ of alumina with a gas phase method ($Al_2O_3$, produced by DEGUSSA AG.), 3.0 g/m$^2$ of polyvinyl alcohol (PVA235, produced by Kuraray Co., Ltd.), and 0.6 g/m$^2$ of boric acid.

Solubility Test of Each of the Fine Organic Particle

Fine organic particle emulsion (L-1) used for preparation of above Recording sheets 2 through 10 was mixed with diethylene glycol monobutyl ether [exhibiting a SP value of 19.437 (MPa)$^{1/2}$, and a boiling point of 230° C.] at room temperature, after which all of the fine particles dissolved.

Observation with Electron Microscope of Surface and Cross-Section of Recording Sheet Observation of Surface and Cross-Section of Unprocessed Recording Sheet Observation of Surface and Cross-Section of Ink-Jet Recording Sheet After Process A Observation with an electron microscope of the surface and the cross-section of Recording sheets 1 through 10, areas of which treated with Process A was conducted, and a state was observed in which the fine organic particles were fused to each other by dissolution or swelling in Recording sheets 2 through 10.

Process A

A 20% solution of diethylene glycol monobutyl ether [exhibiting a SP value: 19.437 (MPa)$^{1/2}$, and a boiling point: 230° C.] was uniformly sprayed onto the surface of Recording sheets 1 through 10, for a coated amount of 20 ml/m$^2$. Subsequently, these were dried under the condition of 23° C. and 55% RH for 1 hr.

Printing of Ink-Jet Image and Evaluation

Printing of Image

A solid cyan image and black lines of 360 dpi were printed onto Recording sheets 1 through 10 using Ink-jet Printer MJ-800C (manufactured by Seiko Epson Corp.) loaded with the manufacturer's ink, at an ink ejecting amount of 12 ml/m$^2$. These images were dried under the condition of 23° C. and 55% RH for 1 hr. "dpi" of the present invention refers to the number of dots per inch (2.54 cm).

Evaluation of Printed Image

Evaluation of the printed images above was performed for beading (mottled unevenness), discoloration resistance and bleeding according to the following methods.

Evaluation of Beading

Beading of each solid cyan image area printed above was observed by changing the observation distance, and evaluated according to the following criteria.

A: at an observation distance of 15 cm, beading of the printed image was not observed.

B: at 30 cm of an observation distance, beading of the printed image was not observed.

C: at 60 cm of an observation distance, beading of the printed image was not observed.

D: at an observation distance of more than 60 cm, beading of the printed image was observed and was problematic in practice.

Evaluation of Discoloration Resistance

Each solid cyan image area printed as above was pasted onto an office interior widow under the condition of being exposed to ambient air but not to direct sunlight for 6 months. The reflection density was measured using single light of red in printed area after and before such exposure for 6 months, and the density residual ratio was determined according to the following formula.

The density residual ratio=(density after exposure for 6 months/density before the exposure)×100 (%)

Evaluation of Bleeding Resistance

Each 360 dpi black line image prepared above was stored under high humidity conditions of 80% RH at 23° C. for 7 days, and then the line width enlarging ratio after and before the storage was determined, defined as [(line width after storage/line width before storage)×100 (%)].

The results obtained in the above evaluation are indicated in following Table 1.

TABLE 1

| Printed Image No. | Recording Sheet No. | Cationic Polymer Compound | Cationic Polymer Added Amount ($g/m^2$) | Polyvalent Metal Compound Compound | Polyvalent Metal Compound Added Amount ($g/m^2$) | Surface Porous Layer (Yes/No) | Evaluation Results: Beading | Evaluation Results: Discoloration Resistance (%) | Evaluation Results: Bleeding Resistance (%) | Remarks |
|---|---|---|---|---|---|---|---|---|---|---|
| 1 | 1 | C-1 | 2.0 | — | — | No | B | 54 | 105 | Comp. |
| 2 | 2 | C-1 | 2.0 | — | — | Yes | D | 88 | 117 | Comp. |
| 3 | 3 | — | — | — | — | Yes | B | 90 | 230 | Comp. |
| 4 | 4 | — | — | $MgCl_2$ | 0.3 | Yes | A | 95 | 115 | Inv. |
| 5 | 5 | — | — | $CaCl_2$ | 0.3 | Yes | A | 94 | 116 | Inv. |
| 6 | 6 | — | — | Paho | 0.3 | Yes | A | 96 | 108 | Inv. |
| 7 | 7 | — | — | Zirconyl acetate | 0.1 | Yes | A | 97 | 105 | Inv. |
| 8 | 8 | C-2 | 0.2 | Paho | 0.3 | Yes | A | 94 | 106 | Inv. |
| 9 | 9 | C-3 | 0.3 | Paho | 0.3 | Yes | A | 93 | 105 | Inv. |
| 10 | 10 | — | — | Alumina | 18 | Yes | A | 93 | 110 | Inv. |

Comp.: Comparative Example
Inv.: Inventive Example

As can clearly be seen from Table 1, it was confirmed that the recording sheet of the present invention which are provided with a surface porous layer on a porous layer, and the surface porous layer containing organic particles A or B as defined in the present invention, and also containing the polyvalent metal compound, exhibited decreased beading (mottled unevenness of images) and improved discoloration resistance of images related to air oxidation and bleeding resistance compared to comparative examples.

The present invention enables production of an ink-jet recording sheet exhibiting superior ink absorption, minimal image deterioration (discoloration) by harmful gases and minimal bleeding.

What is claimed is:

1. An ink-jet recording sheet comprising a support supporting the following layers:

(a) porous layer; and (b) a surface porous layer comprising an organic particle; said organic particle comprising a copolymer having a recurring unit represented by Formula (1) in an amount of not less than 5 weight % based on the total weight of the copolymer, Formula (1)

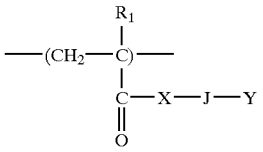

wherein represents —O— or —N($R_2$)—; $R_1$ represents a hydrogen atom or a methyl group; $R_2$ represents a hydrogen atom or an alkyl group having 1 to 8 carbon atoms; J represents an alkylene group having 2 to 18 carbon atoms which may be substituted with an ether group or a thioether group when X is —O—, or J represents a single bond or an alkylene group having 2 to 8 carbon atoms which may be substituted with an ether group or a thioether group when X is —N($R_2$)—; and Y represents a hydrogen atom, a hydroxyl group, an amino group or an alkoxy group;

wherein the surface porous layer is located on the surface side of the sheet as compared with the porous layer, wherein the organic particle has an average particle size of not more than 100 nm and a glass transition temperature of not less than 70° C., and wherein the porous layer or the surface porous layer comprises a compound having a polyvalent metal element.

2. The ink-jet recording sheet of claim 1, wherein the compound having a polyvalent metal comprises zirconium or aluminum.

3. The ink-jet recording sheet of claim 2, wherein the compound having a polyvalent metal is present in an amount of 0.05 to 5.00 $g/m^2$ in the ink-jet recording sheet.

4. The ink-jet recording sheet of claim 1, wherein the organic particle comprises a copolymer having a recurring unit represented by Formula (1) in an amount of not less than 10 weight % based on the total weight of the copolymer.

5. The ink-jet recording sheet of claim 1, wherein the organic particle has an average particle size of not more than 60 nm.

6. The ink-jet recording sheet of claim 1, wherein the surface porous layer comprises the organic particle in an amount of 50 to 90 weight % based on the total weight the surface porous layer.

7. The ink-jet recording sheet of claim 1, wherein the porous layer comprises the compound having a polyvalent metal element.

* * * * *